US007119060B2

(12) United States Patent
Shefer et al.

(10) Patent No.: US 7,119,060 B2
(45) **Date of Patent: *Oct. 10, 2006**

(54) CONTROLLED DELIVERY SYSTEM FOR FABRIC CARE PRODUCTS

(75) Inventors: Adi Shefer, East Brunswick, NJ (US); Samuel David Shefer, East Brunswick, NJ (US)

(73) Assignee: Salvona IP, LLC, Dayton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/342,672

(22) Filed: Jan. 15, 2003

(65) Prior Publication Data

US 2003/0166490 A1 Sep. 4, 2003

Related U.S. Application Data

(63) Continuation of application No. 09/709,062, filed on Nov. 9, 2000, now Pat. No. 6,531,444.

(51) Int. Cl.
*C11D 3/37* (2006.01)

(52) U.S. Cl. ..... 510/519; 510/521; 510/438

(58) Field of Classification Search ..... 510/516, 510/443, 444, 101

See application file for complete search history.

(56) References Cited

U.S. PATENT DOCUMENTS

| | | | | |
|---|---|---|---|---|
| 3,686,025 | A | 8/1972 | Morton | 117/140 |
| 3,689,435 | A | 9/1972 | Berni et al. | 252/524 |
| 4,145,184 | A | 3/1979 | Berni et al. | 8/137 |
| 4,152,272 | A | 5/1979 | Young | 510/101 |
| 4,209,417 | A | 6/1980 | Whyte | 510/438 |
| 4,250,043 | A | 2/1981 | Jones | 510/327 |
| 4,339,356 | A | 7/1982 | Whyte | 512/4 |
| 4,402,856 | A | 9/1983 | Schnoring et al. | 428/402.22 |
| 4,434,086 | A | 2/1984 | Hill et al. | 428/221 |
| 4,446,032 | A | 5/1984 | Munteanu et al. | 510/515 |
| 4,464,271 | A | 8/1984 | Munteanu et al. | 510/515 |

(Continued)

FOREIGN PATENT DOCUMENTS

| | | |
|---|---|---|
| GB | 1400898 | 7/1972 |

(Continued)

OTHER PUBLICATIONS

Definition of "amphiphilic" -Merriam-Webster OnLine; http://www.m-w.com/cgi-bin/dictionary?book=Dictionary&va=amphiphilic.

(Continued)

*Primary Examiner*—John R. Hardee
(74) *Attorney, Agent, or Firm*—Mathews, Shepherd, McKay & Bruneau, P.A.

(57) ABSTRACT

The present invention relates to a controlled delivery system that can be incorporated in liquid, as well as, dry granular, or powder, fabric care products, such as fabric softeners, laundry detergents, rinse added products, and other fabric care products, to enhance fragrance performance. The controlled delivery system of the present invention is a solid, substantially spherical particle comprising hydrophobic cationic charge enhancing agents in conjunction with cationic fabric softening agents that assist in adhering the particles onto fabric. The particles can also include a fragrance. The particle can have an average particle diameter of from about 1 micron to about 500 microns. The controlled delivery system of the present invention can be utilized to deliver a broad range of fragrance ingredients onto fabric and prolong fragrance release from the dry laundered fabric over an extended period of time, or yield a high impact fragrance "burst" upon ironing the fabric. The invention also pertains to fabric care products comprising the controlled release system of the present invention.

21 Claims, 6 Drawing Sheets

U.S. PATENT DOCUMENTS

| | | | | |
|---|---|---|---|---|
| 4,476,041 | A | 10/1984 | Hill et al. | 510/101 |
| 4,488,973 | A | 12/1984 | Hill et al. | 424/69 |
| 4,536,315 | A | 8/1985 | Ramachandran et al. | 510/349 |
| 4,636,330 | A | 1/1987 | Melville | 8/137 |
| 4,842,761 | A | 6/1989 | Rutherford | 510/297 |
| 4,919,841 | A | 4/1990 | Kamel et al. | 252/186.26 |
| 4,946,624 | A | 8/1990 | Michael | 510/101 |
| 4,954,285 | A | 9/1990 | Wierenga et al. | 510/101 |
| 4,973,422 | A | 11/1990 | Schmidt | 510/337 |
| 5,066,419 | A | 11/1991 | Walley et al. | 510/396 |
| 5,094,761 | A | 3/1992 | Trinh et al. | 510/515 |
| 5,102,564 | A | 4/1992 | Gardlik et al. | 427/394 |
| 5,112,688 | A | 5/1992 | Michael | 428/402.2 |
| 5,126,061 | A | 6/1992 | Michael | 510/106 |
| 5,137,646 | A | 8/1992 | Schmidt et al. | 510/515 |
| 5,154,842 | A | 10/1992 | Walley et al. | 510/523 |
| 5,188,753 | A | 2/1993 | Schmidt et al. | 510/395 |
| 5,207,933 | A | 5/1993 | Trinh et al. | 510/517 |
| 5,232,612 | A | 8/1993 | Trinh et al. | 510/515 |
| 5,232,613 | A | 8/1993 | Bacon et al. | 510/101 |
| 5,234,610 | A | 8/1993 | Gardlik et al. | 510/327 |
| 5,234,611 | A | 8/1993 | Trinh et al. | 510/523 |
| 5,236,615 | A | 8/1993 | Trinh et al. | 510/349 |
| 5,246,603 | A | 9/1993 | Trinh et al. | 510/519 |
| 5,281,355 | A | 1/1994 | Tsaur et al. | 510/393 |
| 5,288,423 | A | 2/1994 | Behan et al. | 510/119 |
| 5,324,444 | A | 6/1994 | Berry et al. | 512/4 |
| 5,385,959 | A | 1/1995 | Tsaur et al. | 510/530 |
| 5,425,887 | A | 6/1995 | Lam et al. | 510/520 |
| 5,476,660 | A | 12/1995 | Somasundaran et al. | 424/401 |
| 5,506,201 | A | 4/1996 | McDermott et al. | 512/4 |
| 5,508,259 | A | 4/1996 | Holzner et al. | 512/4 |
| 5,543,157 | A | 8/1996 | Trinh et al. | 424/493 |
| 5,562,847 | A | 10/1996 | Waite et al. | 510/519 |
| 5,648,328 | A | 7/1997 | Angell et al. | 510/441 |
| 5,656,584 | A | 8/1997 | Angell et al. | 510/441 |
| 5,668,097 | A | 9/1997 | Trinh et al. | 510/293 |
| 5,691,303 | A | 11/1997 | Pan et al. | 512/4 |
| 5,814,592 | A | 9/1998 | Kahn et al. | 510/304 |
| 5,840,668 | A | 11/1998 | Behan et al. | 510/112 |
| 5,858,959 | A | 1/1999 | Surutzidis et al. | 510/507 |
| 5,955,419 | A | 9/1999 | Barket, Jr. et al. | 510/507 |
| 6,021,540 | A | 2/2000 | Miller et al. | 15/160 |
| 6,024,943 | A | 2/2000 | Ness et al. | 424/59 |
| 6,025,319 | A | 2/2000 | Surutzidis et al. | 510/441 |
| 6,042,792 | A | 3/2000 | Shefer et al. | 422/259 |
| 6,048,830 | A | 4/2000 | Gallon et al. | 510/349 |
| 6,051,540 | A | 4/2000 | Shefer et al. | 510/101 |
| 6,083,899 | A | 7/2000 | Baker et al. | 510/515 |
| 6,093,691 | A | 7/2000 | Sivik et al. | 510/515 |
| 6,395,302 | B1 | 5/2002 | Hennink et al. | 424/489 |
| 6,531,444 | B1 * | 3/2003 | Shefer et al. | 510/519 |

FOREIGN PATENT DOCUMENTS

| | | | |
|---|---|---|---|
| GB | 1460646 | | 10/1974 |
| WO | WO 99/16804 | * | 4/1999 |

OTHER PUBLICATIONS

Definition of "amphiphillic" -Hawley's Condensed Chemical Dictionary, 12th Ed., Revised by Richard J. Lewis, Sr., Van Nostrand Reinhold.

Risch, S.J (Editor) and Reineccius, G.A (Editor), "Flavor Encapsulation", ACS Symposium Series, 1988.

Richmond, J.M., "Cationic Surfactants; Organic Chemistry", Surfactant Sciences Series, vol. 34, pp. ii-1.

"The Extra Pharmacopoeia", The Pharmaceutical Press, 28th Edition, pp. 1063-1072 (1982).

"Preparation of Micropellets by Spray Congealing", pp. 17-34, edited by Ghebre-Sellassie, I., Drugs and Pharmaceutical Sciences, vol. 65, 1994.

* cited by examiner

CONTROLLED DELIVERY SYSTEM FOR FABRIC CARE PRODUCTS

This is a continuation of U.S. application Ser. No. 09/709,062, filed Nov. 9, 2000, now U.S. Pat. No. 6,531,444.

BACKGROUND OF THE INVENTION

1. Field of the Invention

The present invention relates to a controlled release carrier system that can be incorporated into fabric care products, such as fabric softener, laundry detergents, rinse added products, and other fabric care products, and that enhances fragrance deposition onto fabric and which provides prolongs release of an active agent, such as a fragrance from the dry laundered fabric over an extended period of time, or yields a high impact fragrance "burst" upon ironing the fabric.

2. Description of the Related Art

The household industry has searched for many years for ways to enhance the performance of fabric care products and make them more aesthetically pleasing for the consumers. Consumer acceptance of laundry products is determined not only by the performance achieved with these products but the aesthetics associated therewith. Fragrance is an important aspect of the successful fabric care products and they are being utilized, in addition to imparting an aesthetically pleasing odor, to convey to the consumer the product performance and effectiveness (i.e., the fabric is clean, freshly washed, etc.).

Fragrances are typically added to fabric care products to provide a fresh, clean impression for these products as well as the laundered fabric. While the fragrance does not add to the performance of fabric care products, it does make these products more aesthetically pleasing and the consumer has come to expect such products to have a pleasing odor. The fragrance plays a major, and often determining, role for the consumer in selecting and purchasing the fabric care product. Consumers are becoming increasingly educated and expect a high level of sophistication in their fabric care products. Many consumers would prefer for the fragrance, present in these products, to be deposited on the fabric and remain there for an extended period of time to convey a lasting impression of freshness. Consumers are also interested in fabric care products that deposit high level of fragrance onto the fabric and release the fragrance upon ironing. Fragrance creation for fabric care products is restricted not only by considerations such as availability and cost, but also by compatibility of the fragrance ingredients with other components in the product composition and the ability of the fragrance ingredients to deposit onto the fabric and survive the wash and rise process. Furthermore, large amount of fragrance is being lost during the drying process, even when the fabrics are line dried. Practice has shown that when currently available fabric care products are used, a large fraction of the fragrance is lost during the rinse process due to the solubility of certain fragrance ingredients in aqueous washing compositions, and the fraction of the fragrance which was deposited, quickly evaporates, due to the volatility of fragrance ingredients.

Typical fabric care products such as laundry detergent compositions and fabric softener compositions contain 0.5% to 1% by weight fragrance in their formulations. U.S. Pat. No. 6,051,540, issued to the inventor of this disclosure, discloses that in the course of the washing process wherein clothes are washed with the standard powdered laundry detergent, or fabric softener rinse, a very small fraction of the fragrance that is contained in these fabric care products is actually transferred to the clothes. Tests are described showing that the amount of fragrance that is left as a residue on the clothes can be as low as 1% of the original small amount of fragrance that is contained in these products formulation itself.

Attempts have been made to increase fragrance deposition onto fabric and to hinder or delay the release of the perfume so that the laundered fabric remains aesthetically pleasing for a prolonged length of time. One approach used a carrier to bring the fragrance to the clothes. The carrier is formulated to contain a fragrance and to attach itself to the clothes during the washing cycle through particle entrainment or chemical change.

Perfumes have been adsorbed onto various materials such as silica and clay to deliver perfume in detergents and fabric softeners. U.S. Pat. No. 4,954,285 discloses perfume particles especially for use in dryer released fabric softening/antistatic agents. The perfume particles are formed, by adsorbing the perfume onto silica. The particles have a diameter of greater than about one micron. The particles can be used to reduce the shiny appearance of visible softener spots, which occasionally are present on fabrics treated with said fabric softening compositions and to maintain a relatively constant viscosity of the molten softening composition. The perfume particles are especially adapted for inclusion in dryer activated solid fabric softener compositions including coated particles of fabric softener, which are added to a detergent composition for use in the washing of fabrics. The compositions release softener to the fabrics in the dryer and improve the aesthetic character of any fabric softener deposits on fabrics. The perfume particles can also be admixed with detergent granules and can either be coated or uncoated. This system has the drawback that the fragrance oil is not sufficiently protected and is frequently lost or destabilized during processing.

U.S. Pat. Nos. 4,946,624, 5,112,688, and 5,126,061 disclose microcapsules, prepared by a coacervation process. The microcapsules have a complex structure in which there is a large central core of encapsulated material, preferably perfume, and the walls contain small wall inclusion particles of either the core material or some other material that can be activated to disrupt the wall. The microcapsules that are prepared by coacervation and contain perfume are incorporated into fabric softener compositions that have a pH of about 7 or less and which contain cationic fabric softener. The encapsulated perfume preferably does not contain large amounts of relatively water-soluble ingredients. Such ingredients are added separately to the fabric softener compositions. Ingredients that have high and low volatilities as compared to desired perfume, can either be added to, or removed from, the perfume to achieve the desired volatility. These type of controlled release system have the limitation of not working with all type of fragrance ingredients, especially not with fragrance ingredients that are relatively water-soluble and do not deposit into the fabric.

U.S. Pat. No. 4,402,856 describes the use of coaservation technique to create perfume particles for fabric care products composed of gelatin or a mixture of gelatin with gum arabic, carboxymethylcellulose and/or anionic polymers. The gelatin is hardened with a natural and/or synthetic tanning agent and with a carbonyl compound. According to the invention, the particles adhere to the fabric and are carried over to the dryer. Diffusion of the perfume out of the capsules occurs only in heat-elevated conditions of the dryer.

U.S. Pat. No. 4,152,272 teaches incorporating perfume into wax particles to protect the perfume during storage and through the laundry process. The perfume/wax particles are incorporated into an aqueous fabric conditioner composition. The perfume then diffuses from the particles onto the fabric in the heat-elevated conditions of the dryer.

U.S. Pat. No. 4,919,841 discloses wax encapsulated actives based on emulsion process for household applications including fabric. The process for preparing encapsulated active particles comprises the steps of: dispersing active materials in molten wax; emulsifying the active/wax dispersion in aqueous surfactant solution; quenching the capsules by cooling; and retrieving solidified capsules. The active materials may be selected from chlorine or oxygen bleaching agents, bleach precursors, enzymes, perfumes, fabric softening agents, and surfactants. The resultant capsules are in a form of dispersion (liquid) and have utility for cleaning compositions such as automatic dishwashing detergent formulations.

U.S. Pat. No. 6,042,792 issued to the inventor of this disclosure also describes an aqueous dispersion. A controlled, time-release microparticulate active and bioactive compositions (including perfuming compositions) for targeted delivery to services such as skin, hair and fabric and the environment proximate thereto is described in which the active and bioactive materials have a calculated log P values of between 1 and 8 (P being the n-octanol-water partition coefficient). Such compositions include the active or bioactive material in single phase, solid solution in a wax or polymer matrix also having coated thereon and/or containing a compatible surfactant. Also described are processes and apparatus for preparing such compositions and processes for using same. The fragrance formulation is selected and according this patent has the disadvantage of limiting the type of fragrances that can be used with the system.

U.S. Pat. Nos. 4,446,032 and 4,464,271 disclose liquid or solid fabric softener compositions comprising microencapsulated fragrance suspensions. The compositions contain sustained release fragrances that are prepared by combining non-confined fragrance oils with encapsulated or physically entrapped fragrance oils. These combinations are fashioned so that the free fragrance oil or fragrance oil emulsion, are bound in a network of physically entrapped fragrance oil and suspending agent. The thixatropic pastes or free-flowing powders which result are products where the unconfined fragrance oil or unconfined fragrance oil emulsion, the "encapsulated" or physically entrapped fragrance oil and suspending agent are held together by physical forces. The controlled release system comprise of a mixture of (i) a non-confined fragrance composition; (ii) one or more fragrance oils which are physically entrapped in one or more types of solid particles and (iii) a suspending agent such as hydroxypropyl cellulose, silica, xanthan gum, ethyl cellulose or combinations of the previously mentioned four substances; the non-confined fragrance substance, the entrapped fragrance oil and the suspension agent being premixed prior to the subsequent creation of the liquid or solid fabric softener compositions of matter.

Water soluble polymers have also been used to encapsulate fragrance oils. Such capsules have proved useful in releasing perfume in deodorants. However, such capsules have not been commercially successful in extended release of perfume from fabrics. U.S. Pat. No. 5,425,887 discloses an encapsualted perfume system in tumble dryer articles. The encapsulating material is a water-soluble natural or synthetic polymer with a molecular weight of less than about 300,000 that will release the perfume in response to moisture. Since these systems are water sensitive, these types of particles cannot be incorporated in aqueous fabric softener compositions.

U.S. Pat. Nos. 5,066,419, and 5,154,842 disclose coated perfume particles. The perfume particles comprise perfume dispersed within certain water-insoluble non-polymeric carrier materials and encapsulated in a protective shell by coating with a friable coating material. The coated particles allow for preservation and protection of perfumes, which are susceptible to degradation or loss in storage and in cleaning compositions. In use, the surface coating fractures and the underlying carrier/perfume particles efficiently deliver a large variety of perfume types to fabrics or other surfaces.

Several patents disclose the use of controlled release systems based on cyclodextrin complexes for fabric care applications, for example U.S. Pat. Nos. 5,094,761, 5,207,33, 5,232,612, 5,234,611, 5,236,615, 5,102,564, and 5,234,610. These patents disclose that fabric softening compositions, preferably in liquid form, for use in the rinse cycle of home laundry operations are improved by: (a) using certain protected water sensitive materials, especially particulate complexes of cyclodextrins and perfumes, which are protected in fabric softening compositions and/or detergent compositions, by imbedding the particulate complex in relatively high melting protective material that is substantially water-insoluble and, preferably, non-water-swellable and is solid at normal storage conditions, but which melts at the temperatures encountered in automatic fabric dryers (laundry dryers); (b) using soil release polymers to help suspend water-insoluble particles in aqueous fabric softening compositions; and/or (c) preparing the said protected particulate water sensitive materials (complexes) by melting the said high melting materials, dispersing the said particulate complexes, or other water sensitive material, in the molten high melting protective material and dispersing the resulting molten mixture in aqueous media, especially surfactant solution or aqueous fabric softener composition, and cooling to form small, smooth, spherical particles of the particulate complexes, or other water sensitive material, substantially protected by the high melting material. These systems have the disadvantage that the materials are expensive resulting in increased manufacturing costs.

U.S. Pat. Nos. 4,973,422, and 5,137,646 disclose perfume particles for use in cleaning and conditioning compositions. Perfume particles are disclosed comprising perfume dispersed within wax materials. The particles can be further be coated with a material that makes the particles more substantive to the surface being treated for example, fabric in the laundry process. Such materials help to deliver the particles to the fabric and maximize perfume release directly on the fabric. Generally, the coating materials are water-insoluble cationic materials. Cleaning and conditioning compositions comprising these perfume particles are also disclosed.

U.S. Pat. No. 6,024,943 discloses particles containing absorbed liquids and methods of making them. Perfume is absorbed within organic polymer particles, which have a further polymer at their exterior. The polymer incorporates free hydroxyl groups and serves to promote deposition of the particles from a wash or rinse liquor. The polymer may be part of an encapsulating shell, but more conveniently is used as a stabiliser during polymerisation of the particles. Highly hydrolyzed polyvinyl alcohol is preferred. Particles containing organic polymer, which are insoluble in water, with liquid imbibed by the particles, the particles having at their exterior, a polymer which incorporates free hydroxy groups.

U.S. Pat. No. 5,476,660 discloses compositions to deposit an active substance on a target surface. The active substance is left on the surface after the product is rinsed off the surface. The preferred deposition is from compositions containing an anionic or nonionic active in the co-presence of an anionic surfactant. The compositions contain carrier particles having a zwitterionic or cationic surface and a plurality of outwardly protruding filaments containing charged organocarbyl groups. The term "zwitterionic" employed in this patent means a mixture of cationic and anionic (not necessarily neutral); thus the surface of the zwitterionic particles, have both cationic and anionic groups (i.e., positively charged and negatively charged organocarbyl groups). The active substance is contained within the carrier particles. Examples of target surfaces are mammalian skin, hair or nails.

U.S. Pat. No. 6,051,540 discloses a method employing drum chilling for production fragrance-containing long lasting solid particle for incorporation into laundry detergents, fabric softener compositions, and drier-added fabric softener articles. The invention relates to encapsulating a pre-selected fragrance in a fat and a solid, non-ionic, surface active agent, from the group consisting of SPAN® surfactants for the purpose of imparting a fragrance to a laundry detergent composition, a fabric softener composition or a drier-added fabric softener. The invention also relates to a method of formulating a pre-selected fragrance formulation and a fat and surface-active agent carrier for the pre-selected fragrance formulation. The emphasis of U.S. Pat. No. 6,051,540 is in engineering the fragrance formulation and thus limiting the type of fragrances that can be used with the system. This patent also has the drawback that production of these particles, consists of a two step process (i.e., drum chilling and grind) which makes the production of this fragrance-particles to have high manufacturing costs.

U.S. Pat. No. 6,083,899 discloses fabric softener compositions that have enhanced softening benefits. The fabric softeners of consist of a fabric softener active in combination with a cationic charge booster. The cationic charge boosters disclosed are suitable for use with any fabric softener active, preferably with diester and diamide quaternary ammonium (DEQA) compounds. The invention only relates to the enhanced performance of the fabric softener actives as a result of incorporating the cationic charge boosters in these compositions. The invention does not disclose the use of cationic charge booster to deposit particles onto fabric.

The prior art of which applicant is aware does not set forth a fragrance controlled release system that can be incorporated in liquid, as well as, dry granular, or powder, fabric care products to enhance fragrance performance, especially not for fragrance ingredients that are more soluble into the aqueous phase of the washing compositions and do not deposit onto the fabric. There is also a need for a fragrance carrier system, for fabric care products, that will allow using a wider range of fragrance ingredients that are currently not substantive on fabric and improved fragrance substantivity and longevity onto the laundered fabric. It is desirable to provide a control release system for overcoming these limitations. It is also desirable to provide a method using an efficient and economical process for delivering a broad range of fragrance ingredients onto fabric and prolong fragrance release from the dry laundered fabric over an extended period of time, or yields a high impact fragrance "burst" upon ironing the fabric.

SUMMARY OF THE INVENTION

The present invention relates to an improved carrier system for fabric care products, such as fabric softener, laundry detergents, rinse added products, and other fabric care products, comprising particles formed of hydrophobic polymers and copolymers in combination with an active agent, such as a fragrance, cationic charge booster and cationic fabric softener agent to improve fragrance deposition onto the laundered fabric. The fragrance carrier system also provides controlled release or prolonged fragrance release from the dry laundered fabric over an extended period of time, or yields a high impact fragrance "burst" upon ironing the fabric.

In one embodiment, the present invention provides an improved fragrance carrier system for fabric care products, that has improved fragrance substantivity to bring the fragrance onto clothes which have been laundered and/or which have been treated with fabric softeners and/or which have been treated with rinse added, or drier-added fabric softener products. In the fabric care industry, the term "substantivity" refers to the deposition of the fragrance on the clothes and the retention and perception of the fragrance on the laundered clothing and on the clothing treated with fabric care product. The cationic surface-active agents comprising the fragrance carrier system of the present invention allow a wide range of fragrances and fragrance ingredients to be compatible within the carrier composition and increase the substantivity of fragrances and fragrance ingredients that are currently not substantive on fabric. The fragrance-carrier system also provides prolong fragrance release from the dry laundered fabric over an extended period of time, or yields a high impact fragrances "burst" upon ironing the fabric. In addition, the production of the fragrance-carrier system utilizes minimum processing steps and is efficient and economical.

The carrier system of the present invention is a solid, substantially smooth and spherical particle characterized by:

(i) protection of the volatile constituents of the fragrance during storage, until needed;

(ii) enhanced fragrance deposition onto fabric;

(iii) prolonged fragrance release from the dry laundered fabric over an extended period of time; or (iv) yield high impact fragrance "burst" upon ironing the fabric.

The invention also provides a process for producing the solid particles of the present invention that comprises the steps of:

(i) heating matrix materials, such as solid hydrophobic polymers and co-polymers, cationic charge boosters, and cationic fabric softening agents to about 10 degrees C. above the melting point of the ingredients, with continuous agitation;

(ii) adding an agent such as a fragrance to the melt with continuous agitation; and (iii) cooling said melt to ambient temperature to form a dry free-flowing powder composition. The molten mixture can be converted into a free-flowing powder by spraying processes known in the art, such as spray chilling, granulation, and the like, to create fine or very fine particles, mostly of a substantially spherical shape, having an average particle diameter of from about 1 microns to about 500 microns, or more preferably having an average particle diameter of from about 50 microns to about 200 microns.

The invention also provides a fabric care product such as fabric softener, laundry detergents, rinse added products, and other fabric care products, comprising the fragrance controlled release system of the present invention. Fabric laundered with powder laundry detergent and liquid fabric softener comprising the particles of the present invention were observed to exhibit high level of fragrance (high odor intensity) in both the wet and the dry state and fragrance perception on the dry laundered fabric has been observed to be perceived over an extended period of time, i.e., two to three weeks.

The present invention addresses the foregoing need to increase the deposition of wide range of fragrance and fragrance ingredients onto fabric and prolong their release so that the laundered fabric remains aesthetically pleasing for an extended period of time by employing an advanced carrier system to bring the fragrance onto the clothes.

It is believed that the highly substantive cationic charge booster in conjunction with the cationic fabric softening agents in the particles composition becomes associated, in use of the composition, with the fabric and assists in adhering the particles onto fabric during the washing cycle through both particle entrainment and electrostatic interactions to effectively deliver fragrance onto fabric and sustain their release rate. The hydrophobic polymers and copolymers sustain the diffusion rate of the fragrance through the particles and enable the fragrance to be released from the dry laundered fabric over an extended period of time, or during heat treatment such as ironing.

The fragrance-particle of the present invention can comprises from about 1% to about 95% by weight hydrophobic polymers, hydrophobic copolymers, or a mixture thereof, from about 0.1% to about 10% by weight cationic charge booster, from about 0.1% to about 50% by weight cationic fabric softening agents, and from about 1% to about 50% by weight fragrance. The particles have an average particle size in the range from about 1 micron to about 500 microns and having a melting point in the range from about 60 degrees C. to about 150 degrees C. The particles can be incorporated into any fabric care products, preferably in fabric softener or laundry detergent compositions.

Additional components can be added to the fragrance carrier system or can be incorporated into the particle matrix. For example, additional components that can be included in the fragrance carrier system are: ironing aids such as silicones; anti-shrinkage agents; anti-wrinkle agents; fabric crisping agents; spotting agents; germicides; fungicides; stabilizers preservatives; bactericides which can be effective to protect the composition or to treat fabrics; flow agents; and mixtures thereof. The additional components are usually present in an amount from about 1% to about 10% by weight of the particles.

The carrier system of the present invention can be incorporated in liquid as well as dry granular or powder fabric care compositions and provide long-term storage stability.

DETAILED DESCRIPTION

Figure 1:
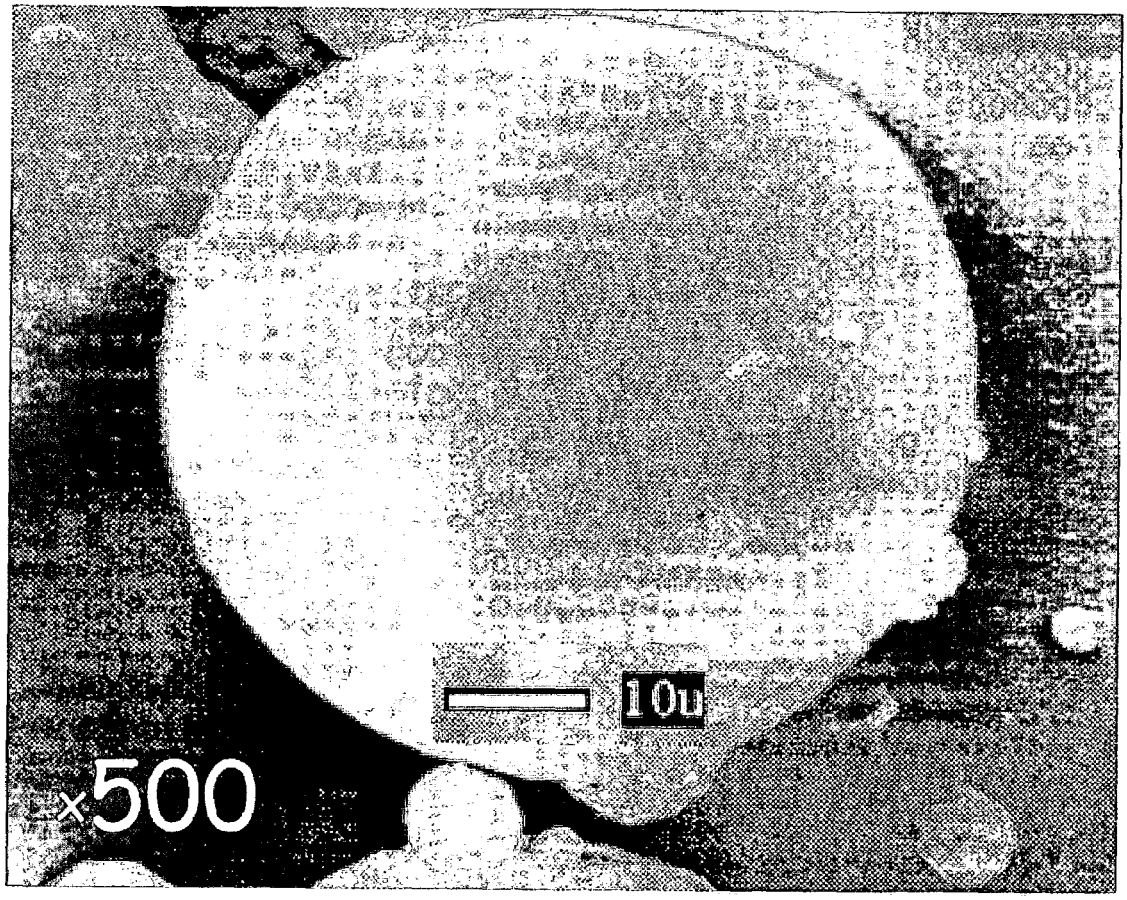
FIG. 1 is a scanning electron microscopy (SEM) image magnified 500 times of fragrance carrier particles formed by example 2 of the present invention.

The present invention features a method of controlling the release rate of an active agent, such as a fragrance, that can be incorporated in a fabric care product, over an extended period of time, or yields a high impact fragrance "burst" upon ironing. The carrier system of the present invention comprises substantially solid particles in combination with a cationic charge booster and cationic fabric softener. The term "particles" is intended to describe solid, substantially spherical particulates. It will be appreciated that other particle shapes can be formed in accordance with the teachings of the present invention.

The particles of the present invention have a predetermined particle size. The low end of the useful size range of the particles is limited by undue loss of fragrance from the particle. The permeation rate of the fragrance from the particle is proportional to particle size such that the smaller particles, the faster the rate that fragrance that is being released. Fragrance containing particles of the present invention have an average diameter in the range from about 1 micron to about 500 microns. Preferably, the particle size of the fragrance-containing particles is in the range from about 50 microns to about 200 microns. It has been found that particles within the range of about 50 microns to about 200 microns are efficiently entrained on fabric surfaces and are not noticeable on the fabrics. This linear dimension for any individual particle represents the length of the longest straight line joining two points on the surface of the particle.

Additional components can be added to the fragrance carrier system or can be incorporated into the particle matrix. For example, additional components that can be included in the fragrance carrier system are: ironing aids such as silicones; anti-shrinkage agents; anti-wrinkle agents; fabric crisping agents; spotting agents; germicides; fungicides; stabilizers preservatives; bactericides which can be effective to protect the composition or to treat fabrics; flow agents; and mixtures thereof. The additional components are usually present in an amount from about 1% to about 10% by weight of the particles.

I. Cationic Charge Boosters

The fragrance carrier system of the present invention comprises a cationic charge booster. Suitable cationic charge boosters are described in U.S. Pat. No. 6,083,899 hereby incorporated by reference into this application. The preferred cationic charge boosters of the present invention are described herein below.

I.a. Quaternary Ammonium Compounds

A preferred composition of the present invention comprises at least about 0.1%, preferably from about 0.1% to about 10%, more preferably from about 0.1% to about 5% by weight, of a cationic charge booster having the formula:

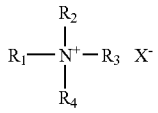

wherein $R_1$, $R_2$, $R_3$, and $R_4$ are each independently $C_1$–$C_{22}$ alkyl, $C_3$–$C_{22}$ alkenyl, $R_5$-Q-$(CH_2)_m$—, wherein $R_5$ is $C_1$–$C_{22}$ alkyl, and mixtures thereof, m is from 1 to about 6; X is an anion. Preferably $R_1$ is $C_6$–$C_{22}$ alkyl, $C_6$–$C_{22}$ alkenyl, and mixtures thereof, more preferably $R_1C_{11}$–$C_{18}$ alkyl, $C_{11}$–$C_{18}$ alkenyl, and mixtures thereof; $R_2$, $R_3$, and $R_4$ are each preferably $C_1$–$C_4$ alkyl, more preferably each $R_2$, $R_3$, and $R_4$ are methyl.

Alternatively, $R_1$ can be a $R_5$-Q-$(CH_2)_m$— moiety wherein $R_5$ is an alkyl or alkenyl moiety having from 1 to 22 carbon atoms, preferably the alkyl or alkenyl moiety when taken together with the Q unit is an acyl unit. For example Q can be derived from a source of triglyceride selected from tallow, partially hydrogenated tallow, lard, partially hydrogenated lard, vegetable oils, partially hydrogenated vegetable oils, such as canola oil, safflower oil, peanut oil, sunflower oil, corn oil, soybean oil, tall oil, rice bran oil, and the like and mixtures thereof.

An example of a fabric softener cationic booster comprising a $R_5$-Q-$(CH_2)_m$— moiety has the formula:

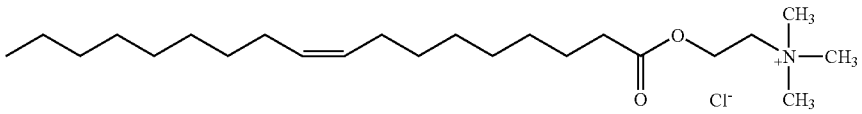

wherein $R_5$-Q-represents oleoyl units and m is equal to 2.

Preferably X is a softener compatible anion, such as the anion of a strong acid. For example, X can be chloride, bromide, methylsulfate, ethylsulfate, sulfate, nitrate and mixtures thereof. More preferably X is chloride and methyl sulfate.

I.b. Polyvinyl Amines

A preferred composition according to the present invention contains at least about 0.1%, preferably from about 0.1% to about 10%, more preferably from about 0.1% to about 5% by weight, of one or more polyvinyl amines charge boosters having the formula

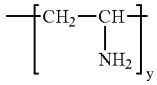

wherein y is from about 3 to about 10,000, preferably from about 10 to about 5,000, more preferably from about 20 to about 500. Polyvinyl amines suitable for use in the present invention are available from BASF under the name Lupasol® 321. The greater number of amine moieties per unit weight on the polyvinyl amines provides preferred substantial charge density.

I.c. Polyalkyleneimines

A preferred composition of the present invention comprises at least about 0.1%, preferably from about 0.1% to about 10%, more preferably from about 0.1% to about 5% by weight, of a polyalkyleneimine charge booster having the formula:

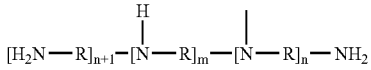

wherein the value of m is from 2 to about 700 and the value of n is from 0 to about 350. Preferably the compounds of the present invention comprise polyamines having a ratio of m:n that is at least 1:1 but may include linear polymers (n equal to 0) as well as a range as high as 10:1, preferably the ratio is 2:1. When the ratio of m:n is 2:1, the ratio of primary:secondary:tertary amine moieties of —$RNH_2$, —RNH, and —RN moieties, is 1:2:1. R can be $C_2$–$C_8$ alkylene, $C_3$–$C_8$ alkyl substituted alkylene, and mixtures thereof. Preferably R is ethylene, 1,2-propylene, 1,3-propylene, and mixtures thereof, and more preferably ethylene. R radicals serve to connect the amine nitrogens of the backbone.

Optionally, one or more of the polyvinyl amine backbone —$NH_2$ unit hydrogens can be substituted by an alkyleneoxy unit having the formula:

wherein $R_1$ is $C_2$–$C_4$ alkylene; $R_2$ is hydrogen, $C_1$–$C_4$ alkyl, and mixtures thereof; and x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

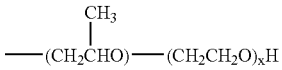

wherein x has the value of from 1 to about 50. Substitutions such as the above are represented by the abbreviated formula PO-EO.sub.X—. However, more than one propyleneoxy unit can be incorporated into the alkyleneoxy substituent.

The preferred polyamine cationic charge boosters of the present invention comprise backbones wherein less than about 50% of the R groups comprise more than 3 carbon atoms. The use of two and three carbon spacers as R moieties between nitrogen atoms in the backbone is advantageous for controlling the charge booster properties of the molecules. More preferred embodiments of the present invention comprise less than about 25% moieties having more than 3 carbon atoms. Yet more preferred backbones comprise less than about 10% moieties having more than 3 carbon atoms. Most preferred backbones comprise abfout 100% ethylene moieties.

The cationic charge boosting polyamines of the present invention comprise homogeneous or non-homogeneous polyamine backbones, preferably homogeneous backbones.

For the purpose of the present invention the term "homogeneous polyamine backbone" is defined as a polyamine backbone having R units that are the same such as, all ethylene. However, this definition does not exclude polyamines that comprise other extraneous units comprising the polymer backbone that are present due to an artifact of the chosen method of chemical synthesis. For example, it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention.

For the purposes of the present invention the term "non-homogeneous polymer backbone" refers to polyamine backbones that are a composite of one or more alkylene or substituted alkylene moieties, for example, ethylene and 1,2-propylene units taken together as R units.

However, not all of the suitable charge booster agents belonging to this category of polyamine comprise the above described polyamines. Other polyamines that comprise the backbone of the compounds of the present invention are generally polyalkyleneamines (PAA's), polyalkyleneimines (PAI's), preferably polyethyleneamine (PEA's), or polyethyleneimines (PEI's). Polyethyleneimines suitable for use in the present invention are available from BASF under the trade name Lupasol® such as Lupasol™ PR8515, having an average molecular weight of 1,800. A common polyalkyleneamine (PAA) is tetrabutylenepentamine. PEA's can be obtained by reactions involving ammonia and ethylene dichloride, followed by fractional distillation. The common PEA's obtained are triethylenetetramine (TETA) and tetraethylenepentamine (TEPA). Above the pentamines, such as, the hexamines, heptamines, octamines and possibly nonamines, the cogenerically derived mixture does not appear to separate by distillation and can include other materials such as cyclic amines and particularly piperazines.

I.d. Poly-Quaternary Ammonium Compounds

A preferred composition of the present invention comprises at least about 0.1%, preferably from about 0. 1% to about 10%, more preferably from about 0.1% to about 5% by weight, of a cationic charge booster having the formula:

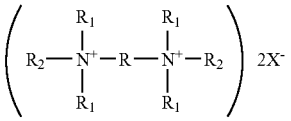

wherein R is substituted or unsubstituted $C_2$–$C_{12}$ alkylene, substituted or unsubstituted $C_2$–$C_{12}$ hydroxyalkylene; each $R_1$ is independently $C_1$–$C_4$ alkyl, each $R_2$ is independently $C_1$–$C_{22}$ alkyl, $C_3$–$C_{22}$ alkenyl, $R_5$-Q-$(CH_2)_m$—, wherein $R_5$ is $C_1$–$C_{22}$ alkyl, $C_3$–$C_{22}$ alkenyl, and mixtures thereof; m is from 1 to about 6; Q is a carbonyl unit as described above and mixtures thereof; X is an anion.

Preferably R is ethylene and $R_1$ is preferably methyl or ethyl, more preferably methyl. Preferably at least one $R_2$ is $C_1$–$C_4$ alkyl, more preferably methyl. Most preferably at least one $R_2$ is $C_{11}$–$C_{22}$ alkyl, $C_{11}$–$C_{22}$ alkenyl, and mixtures thereof.

Alternatively $R_2$ is a $R_5$-Q-$(CH_2)_m$— moiety wherein $R_5$ is an alkyl moiety having from 1 to 22 carbon atoms, preferably the alkyl moiety when taken together with the Q unit is an acyl unit derived from a source of triglyceride selected from the group consisting of tallow, partially hydrogenated tallow, lard, partially hydrogenated lard, vegetable oils, partially hydrogenated vegetable oils, such as, canola oil, safflower oil, peanut oil, sunflower oil, corn oil, soybean oil, tall oil, rice bran oil, and the like and mixtures thereof.

An example of a fabric softener cationic booster comprising a $R_5$-Q-(CH2)$_m$— moiety has the formula:

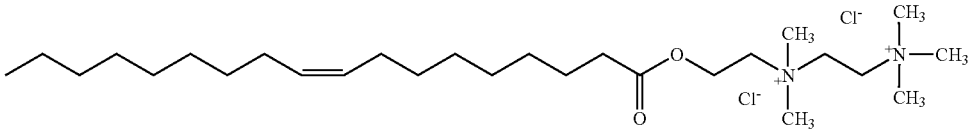

wherein $R_1$ is methyl, one of the $R_2$ units is methyl and the other of the $R_2$ unit is $R_5$-Q-$(CH_2)_m$— wherein $R_5$-Q- is an oleoyl unit and m is equal to 2. X is a softener compatible anion, such as an anion of a strong acid. For example, X can be chloride, bromide, methylsulfate, ethylsulfate, sulfate, nitrate and mixtures thereof More preferably chloride and methyl sulfate.

II. Cationic Fabric Conditioning Agents

The carrier system of the present invention can comprise any of the cationic fabric conditioning agents known in the art. The fabric conditioning agents can include imidazolinium.

Conventional quaternary ammonium fabric conditioning agents useful for the present invention are: di dodecyl dimethyl ammonium bromide, di tetradecyl dimethyl ammonium chloride, di pentadecyl dimethyl ammonium chloride, di dodecyl diethyl ammonium chloride, di tetradecyl dipropyl ammonium chloride, di tallow dimethyl ammonium chloride, di tallow dimethyl ammonium methyl sulphate, di tallow diethyl ammonium chloride, di dodecyl diethyl ammonium chloride, di dodecyl diethyl ammonium acetate and di tallow dipropyl ammonium phosphate. Other useful cationic fabric conditioning agents are: dodecyl trimethyl ammonium bromide, tetradecyl trimethyl ammonium chloride, pentadecyl trimethyl ammonium chloride, cetyl trimethyl ammonium bromide, stearyl trimethyl ammonium bromide, tallow trimethyl ammonium chloride, eicosyl trimethyl ammonium chloride, dodecyl trimethyl ammonium methyl sulphate, tallow trimethyl ammonium acetate and tallow dimethyl benzyl ammonium chloride.

Other quaternary ammonium salt fabric conditioning compounds suitable for use are disclosed by Morton D. R. et al. in U.S. Pat. Nos. 3,686,025 and 6,083,899 are described in "Cationic Surfactants", Surfactant Science series, Vol. 34, edited by Richmond J. M., Marcel Dekker Inc., 1990, which are incorporated herein by reference.

Preferred cationic fabric conditioning agents are dialkyl dimethyl ammonium-chloride or alkyl trimethyl ammonium chloride wherein the alkyl contains from 12 to 20 carbon atoms and are derived from a long chain fatty acids, especially from hydrogenated tallow. The terms "tallow" and "tallowalkyl", used herein, are intended to mean alkyls containing from 16 to 18 carbon atoms. The term "tallowalkoxy" used herein, means an alkyl ether radical wherein the alkyl contains from 16 to 18 carbon atoms. Specific examples of particularly preferred cationic conditioning agents include the following: tallowtrimethyl ammonium chloride; tallow dimethyl (3-tallowalkoxypropyl) ammonium chloride; ditallow dimethyl ammonium chloride; ditallow dimethyl ammonium methyl sulfate; eicosyltrimethyl ammonium chloride; dieicosydimethyl ammonium chloride; dodecyltrimethyl ammonium chloride; didodecyldimethyl ammonium chloride; tetradecyltrimethyl ammonium chloride; ditetradecyldimethyl ammonium chloride; pentadecyltrimethyl ammoaium chloride; dipentadecyltrimethyl ammonium chloride; didodecyldiethyl ammonium chloride; didodecyldipropyl ammonium chloride; ditetradecyldiethyl ammonium chloride; ditetradecyldipropyl ammonium chloride; ditallowdiethyl ammonium chloride; ditallowdipropyl ammonium chloride; tallowdimethyl benzyl ammonium chloride; tallowdiethyl benzyl ammonium chloride; dodecyltrimethyl ammonium methyl sulfate; didodecyldielbyl ammonium acetate; tallowtrimethyl ammonium acetate; tallowdimethyl benzyl ammonium nitrite; ditallowdipropyl ammonium phosphate; dodecyltrimethylammonium chloride, didodecyldimethylammonium methylsulfate; didodecyldipropylammonium ethylsulfate; ditallowdiethylammonium methylsulfate; ditallowdimethylammonium chloride; tallowdimethylbenzylammonium nitrate; ditallowdimethylammonium methylsulfate; ditallowdimethylammonium bisulfate; methyl(1)octadecylamidoethyl(2)octadecyl imidazolinium methylsulfate; methyl( 1)dodecylamidoethyl(2) dodecyl imidazolinium chloride; tallowpyridinium methylsulfate; dodecylpyridinium chloride; dodecylmethylmorpholinium acetate; and tallowethylmorpholinium bromide.

The particularly preferred cationic fabric conditioning agents for the fragrance carrier of the present invention are: behenyltrimethylammonium chloride; ditallowdimethylammonium methylsulfate; ditallowdimethylammonium chloride; methyl(1)stearylamidoethyl(2)stearylimidazolinium methosulfate; methyl(1)stearylamidoethyl(2)stearylimidazolinium chloride; N,N-di(tallowyl-oxy-ethyl)-N,N-dimethyl ammonium chloride; N,N-di(canolyl-oxy-ethyl)-N,N-dimethyl ammonium chloride; N,N-di(tallowyl-oxy-ethyl)-N-methyl, N-(2-hydroxyethyl) ammonium chloride; N,N-di (canolyl-oxy-ethyl)-N-methyl, N-(2-hydroxyethyl) ammonium chloride; N,N-di(2-tallowyloxy-2-oxo-ethyl)-N, N-dimethyl ammonium chloride; N,N-di(2-canolyloxy-2-oxo-ethyl)-N,N-dimethyl ammonium chloride; N,N-di(2-tallowyloxyethylcarbonyloxyethyl)-N,N-dimethyl ammonium chloride; N,N-di(2-canolyloxyethylcarbonyloxyethyl)-N,N-dimethyl ammonium chloride; N-(2-tallowoyloxy-2-ethyl)-N-(2-tallowyloxy-2-oxo-ethyl)-N,N-dimethyl ammonium chloride; N-(2-canolyloxy-2-ethyl)-N-(2-canolyloxy-2-oxo-ethyl)-N,N-dimethyl ammonium chloride; N,N,N-tri(tallowyl-oxy-ethyl)-N-methyl ammonium chloride; N,N,N-tricanolyl-oxy-ethyl)-N-methyl ammonium chloride; N-(2-tallowyloxy-2-oxoethyl)-N-(tallowyl)-N,N-dimethyl ammonium chloride; N-(2-canolyloxy-2-oxoethyl)-N-(canolyl)-N,N-dimethyl ammonium chloride; 1,2-ditallowyloxy-3-N,N,N-trimethylammoniopropane chloride; and 1,2-dicanolyloxy-3-N,N,N-trimethylammoniopropane chloride; and mixtures of thereof.

Methyl-1-tallowamidoethyl-2-tallowimidazolinium methylsulfate available from Witco Chemical Company under the name Varisoft™ 475. Examples of monoalkyltrimethylammonium salts are monotallowtrimethylammonium chloride, mono(hydrogenated tallow)trimethylammonium chloride, palmityltrimethyl ammonium chloride and soyatrimethylammonium chloride, available from Witco Chemical Company under the names Adogen™ 471, Adogen™ 441, Adogen™ 444, and Adogen™ 415, respectively. Examples of behenyltrimethylammonium chloride are commercially available under the name Kemamine™ Q2803-C from Humko Chemical Division of Witco Chemical Corporation. Methylbis(tallowamidoethyl)(2-hydroxyethyl)ammonium methylsulfate and methylbis(hydrogenated tallowamidoethyl)(2-hydroxyethyl)ammonium methylsulfate; are available from Witco Chemical Company under the names Varisoft™ 222 and Varisoft™ 110, respectively: dimethylstearylbenzyl ammonium chloride sold under the names Varisoft™ SDC by Witco Chemical Company and Ammonyx™ 490 by Onyx Chemical Company.

The most preferred quaternary ammonium salt fabric conditioning agents are methyl bis(hydrogenated ditallowamidoethyl)2hydroxyethyl ammonium chloride, commercially available from Croda Inc. under the name INCROSOFT™ 100; methyl bis(hydrogenated tallow amidoethyl)-2-hydroxyethyl ammonium methyl sulfate, commercially available from the Stepan Company under the name ACCOSOFT® 440-75 DEG; methyl (1) hydrogenated tallow amidoethyl(2)hydrogenated tallow imidazolinium methyl sulfate, commercially available from the Stepan Company under the name ACCOSOFT® 808 HT; behenyltrimethylammonium chloride, commercially available under the trade name Kemamine™ Q2803-C from Humko Chemical Division of Witco Chemical Corporation.

III. Matrix Materials

The matrix materials for forming the particles of the carrier system of the present invention comprise any substantially water-insoluble polymers and copolymers compatible with and miscible with the fragrance used in the present invention and harmless or beneficial to the fabrics when dispersed and melted on to them. Examples of suitable hydrophobic polymers and copolymer for use as the matrix material include polyethylene homopolymers A-C® 1702; A-C® 617A, A-C® 617A, and A-C® 15, commercially available from AlliedSignal Inc.; PERFORMALENE™ PL available from Baker Pertolite Co.; polyethylene homopolymer commercially available from New Phase Technologies; ETHYLENE-ACRYLIC ACID COPOLYMERS A-C® 540, A-C® 540A, and A-C® 580 commercially available from AlliedSignal Inc.; polyamides having a molecular weight in the range of from about 6,000 up to about 12,000, for example, MACROMELT™ 6030 manufactured by the Henkel Ag. of Dusseldorf, Germany; VERSALON™ 1135 polyamide polymer available commercially from General Mills, Inc.; polyethylene-vinyl acetate copolymers; silicon copolymer modified waxes, for example; candelilla/silicon copolymer, ozokerite/silicon copolymer (SP 490 and SP 1026), and other silicon copolymer modified natural and synthetic waxes, commercially available from Strahl & Pitsch Inc., reaction products of silicon copolymers with synthetic and natural waxes, for example siliconyl candelilla, and siliconyl synthetic paraffin LMS, commercially available from Koster Keunen Inc. Synthetic and natural waxes can also be utilized as hydrophobic materials for the carrier system of the present invention.

Alternatively, the matrix materials can be formed suitable nontoxic, pharmaceutical solid core materials of inert hydrophobic biocompatible materials with a melting range between about 40 degrees and about 100 degrees C. Examples are natural, regenerated, or synthetic waxes including: animal waxes, such as beeswax; lanolin and shellac wax; vegetable waxes such as carnauba, candelilla, cutina, sugar cane, rice bran, and bayberry wax; mineral waxes such as petroleum waxes including paraffin and microcrystalline wax; and mixtures thereof. Other hydrophobic compounds which may be used include fatty acid esters such as ethyl stearate, isopropyl myristate, and isopropyl palmitate; high molecular weight fatty alcohols such as cetostearyl alcohol, cetyl alcohol, stearyl alcohol, and oleyl alcohol; solid hydrogenated castor and vegetable oils; hard paraffins; hard fats; and mixtures thereof. Other hydrophobic compounds which may be used in the present invention include triglycerides, preferably of food grade purity or better, which may be produced by synthesis or by isolation from natural sources. Natural sources may include animal fat or vegetable oil, such as, soy oil, a source of long chain triglycerides (LCT). Other suitable triglycerides are composed predominantly of medium length fatty acids (C10–C18), denoted medium chain triglycerides (MCT). The fatty acid moieties of such triglycerides can be unsaturated, monounsaturated or polyunsaturated. Mixtures of triglycerides having various fatty acid moieties are also useful for the present invention. The core can comprise a single hydrophobic compound or a mixture of hydrophobic compounds. Hydrophobic materials are known to those skilled in the art and are commercially available, as described in the list of suitable carrier materials in Martindale, The Extra Pharmacopoeia, The Pharmaceutical Press, 28th Edition pp 1063–1072 (1982).

It is preferred that the particles used in the present invention have a melting point in the range from about 60 degrees C. to about 150 degrees C., preferably from about 80 degrees C. to about 100 degrees C. The melting point of the particles is usually a function of the carrier matrix employed. Accordingly, preferred matrix materials have a melting point in the range of about 60 degrees C. to about 150 degrees C., preferably from about 80 degrees C. to about 100 degrees C. It should be understood that it is the melting point of the particle rather than of the carrier matrix that is important for use of the carrier system of the present invention.

Considerations in the selection of the matrix material include good barrier properties to the active agents and the fragrance ingredients, low toxicity and irritancy, stability, and high loading capacity for the active agents of interest.

IV. Fragrances

Preferably, a fragrance is included in the carrier system of the present invention. The fragrance that can be encapsulated in the carrier system of the present invention, can be any odoriferous material and can be selected according to the desires of the fragrance creator. In general terms, such fragrance materials are characterized by a vapor pressure below atmospheric pressure at ambient temperatures. The high boiling perfume materials employed herein will most often be solids at ambient temperatures, but also can include high boiling liquids. A wide variety of chemicals are known for perfumery uses, including materials such as aldehydes, ketones, esters, and the like. More commonly, naturally occurring plant and animal oils and exudates comprising complex mixtures of various chemical components are known for use as fragrances, and such materials can be used herein. Fragrances useful for the present invention can be a single aroma chemical, relatively simple in their composition, or can comprise highly sophisticated, complex mixtures of natural and synthetic chemical components, all chosen to provide any desired odor.

Suitable fragrance which can be used in the present invention comprise, for example the high boiling components of woody/earthy bases containing exotic materials such as sandalwood oil, civet, patchouli oil, and the like. The perfumes herein can be of a light, floral fragrance, such as for example, high boiling components of rose extract, violet, extract, and the like. The perfumes herein can be formulated to provide desirable fruity odors, such as for example lime, lemon, orange, and the like. The perfume can be any material of appropriate chemical and physical properties which exudes a pleasant or otherwise desirable odor when applied to fabrics. Perfume materials suitable for use in the present invention are described more fully in S. Arctander, Perfume Flavors and Chemicals, Vols. I and II, Aurthor, Montclair, N.J. and the Merck Index, 8th Edition, Merck & Co., Inc. Rahway, N.J., both references being incorporated herein by reference.

V. Processing Method

The carrier particles of the present invention can be prepared by co-melting the active agent, such as a fragrance with the matrix materials, cationic charge boosters, and cationic fabric conditioning agents and then converting the molten mass into particles of the desired size by any of the conventional means for converting melted materials to dry particles, such as, by spraying the mass through a nozzle into a cool atmosphere. Particle size selection can be accomplished by screening, airstream segregation, and the like.

The process for producing the fragrance carrier particles comprises the following stages:

(i) heating the matrix materials, such as solid hydrophobic polymers and co-polymers, cationic charge boosters, and cationic fabric softening agents to about 10 degrees above the melting point of the ingredients, with continuous agitation;

(ii) adding the fragrance to the melt with continuous agitation; and (iii) cooling the melt to ambient temperature to form a dry free-flowing powder composition.

The molten mixture can be converted into a free-flowing powder by spraying processes known in the art, such as spray chilling, spray-congealing, granulation, and the like to create fine or very fine particles, of a substantially spherical shape, having an average particle diameter of from about 1 microns to about 500 microns, or more preferably having an average particle diameter of from about 50 microns to about 200 microns.

Spraying processes are particularly suitable in which the melts are converted into fine or very fine particles, primarily of spherical shape, whilst they are finely divided and in free fall. The spraying processes can be assisted by blowing with countercurrent cold air such as by spray-chilling, spray-congealing. Other conventional processes which result in coarse particles are also suitable for producing the fragrance carrier particles according to the invention. The processes include, for example, a process in which the melt is discharged on to a cooled roll or cooling belt, and where the mixture is obtained as a pellet in the shape of a drop or as a chip after the melt has solidified.

A flow agent is preferably added after the powder is manufactured. Flow agents which can be used in the present invention can be silica, clay, starch, and the like which can be added to the fragrance-carrier particles. Suitable fine silica materials are commercially available as pyrogenic or fumed silicas, such as materials sold under Trade names of Cabosil manufactured by G. L. Cabot Inc., Aerogel 500 manufactured by J. M. Huber Corp., Syloid 244, -63, -65 manufactured by W. R. Grace and Co., Li-sil 233 manufactured by Pittsburg Plate Glass Co., and Sipernat D-17 manufactured by Degussa Co. Suitable clay materials include kaolinites and bentonites, as described in British Pat. No. 1,460,646. Preferred are smectite clays described in British Pat. No. 1,400,898, which have textile softening properties. These are three layer, expandable, clays, such as nontronite, saponite and montmorillonite, volchonskoite, hectorite and sauconite. For example, suitable clay materials are available as Thixogel No. 1 and Gelwhite GP and Soft Dark from Georgia Kaolin Co.; Volelay BC and Volclay No. 325 from American Colloid Co., and Veegum Pro and Veegum F. from T. R. Venderbilt.

Spray chilling, or spray congealing is well known in the art and been used commercially in many applications, including foods where the core material is a flavoring oil and cosmetics where the core material is a fragrance oil, see "Flavor Encapsulation", edited by Risch S. J. and Reineccius G. A., ACS Symposium Series, 1988; "Multiparticulate Oral Drug Delivery" pp.17–34, edited by Ghebre-Sellassie I., Drugs and the Pharmaceutical Sciences, Vol. 65, 1994 which are incorporated herein as references.

The processing method described herein is simple and economical and is characterized by high loading, reproducibility, versatility, and stability. The method is further illustrated in the non-limiting examples.

The particles may diffuse at any of the rates of the following:

(i) at steady-state or zero-order release rate in which there is substantially continuous releaser per unit of tim;

(ii) a first-oder release rate in which the rate of release declines toward zero with time; and (iii) a delayed release in which the initial rate is slow, but then increases with time. The active agent contained in the particles can be released an extended period of time up to a period of three weeks. Alternatively, the active agent of the particles is released upon heat treatment of the particles to substantially the melting point of the particles, such as by ironing a fabric having carrier system and adhere thereto.

VI. Particle Adhesion onto Fabric

Figure 2:
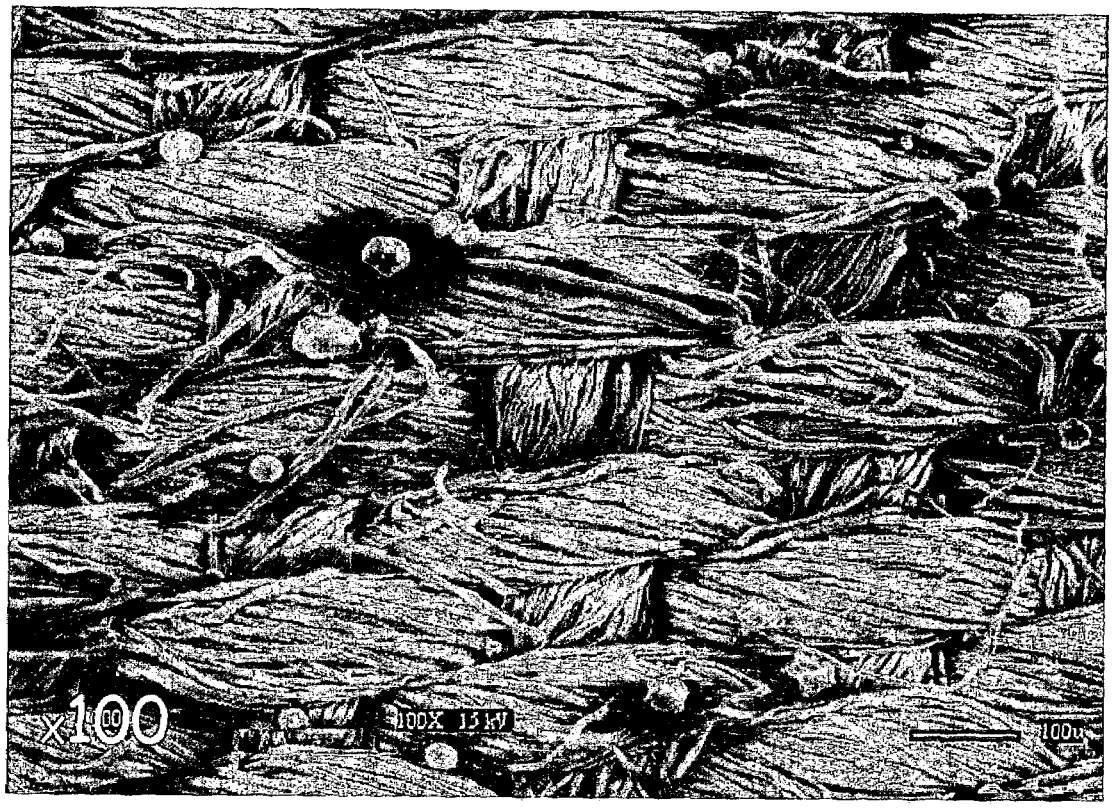
FIG. 2 is a SEM magnified 100 times of fabric washed with a fabric softener including the fragrance carrier particles formed by example 2.
Figure 3:
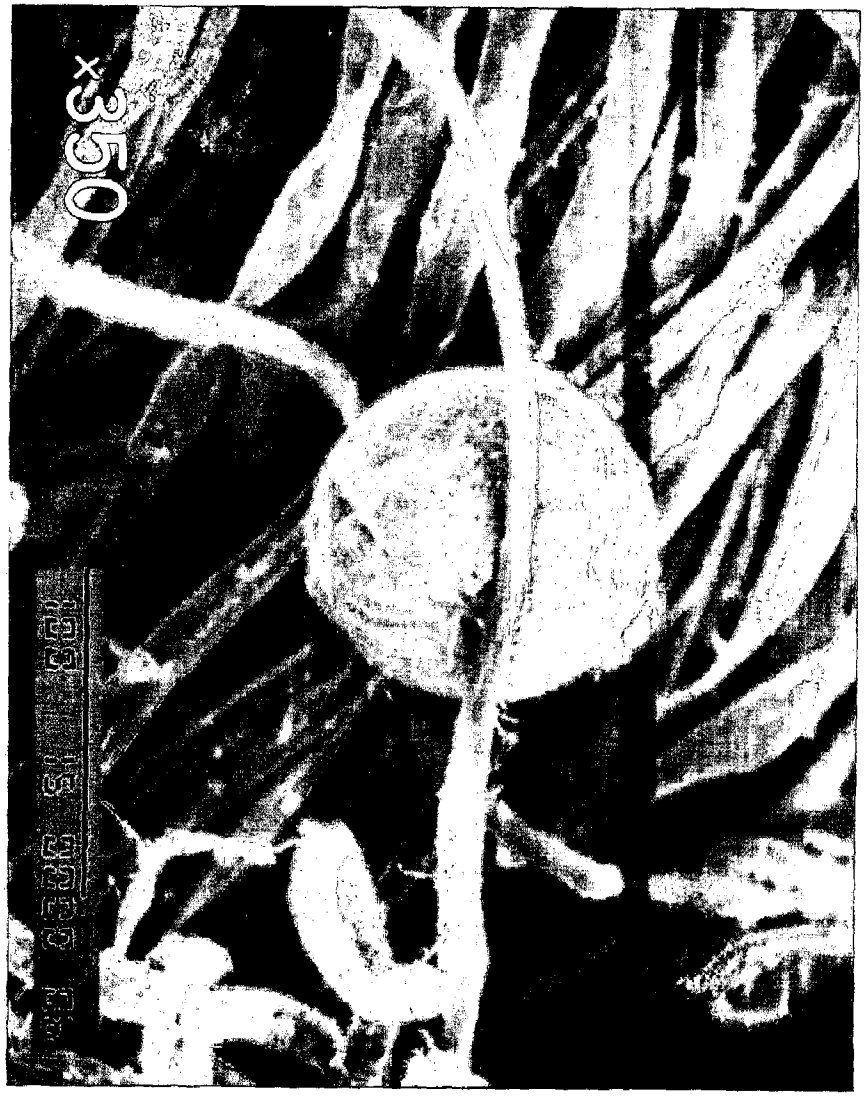
FIG. 3 is a SEM magnified 350 times of fabric washed with a fabric softener including the fragrance carrier particles formed by example 2.
Figure 4:
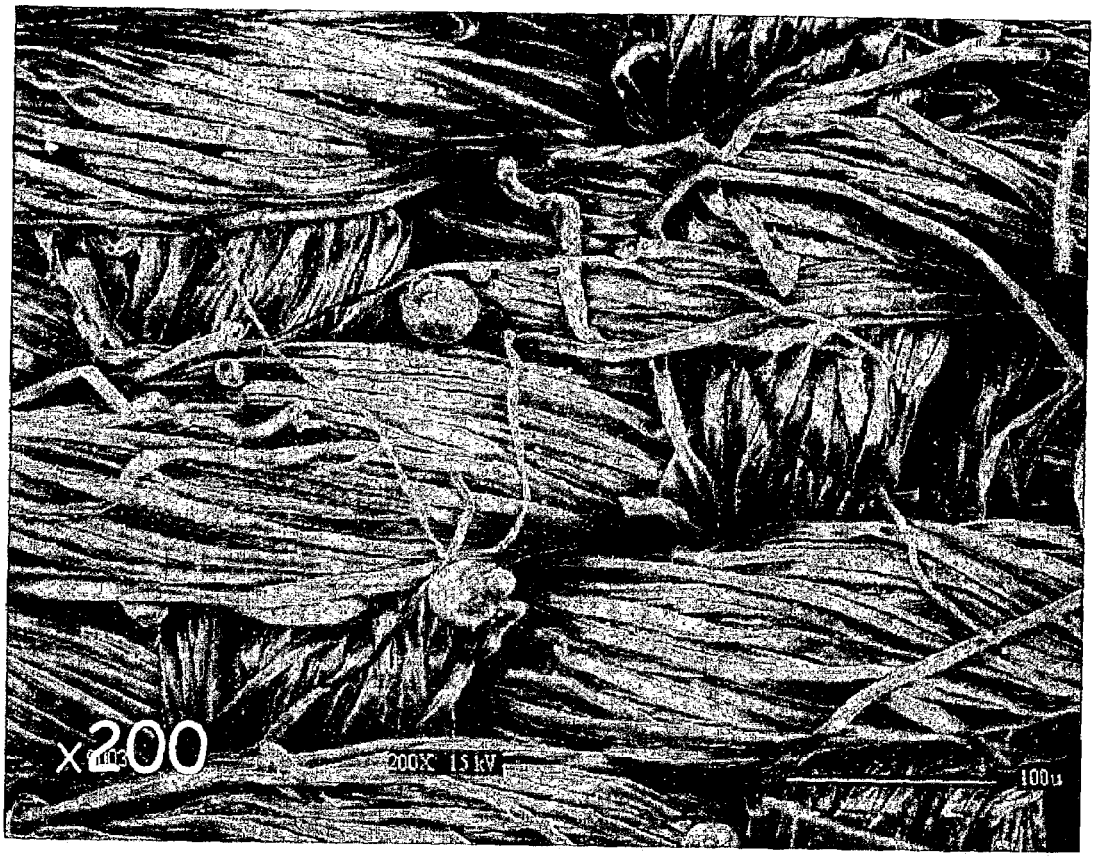
FIG. 4 is a Sem magnified 200 times of a fabric washed with a powder laundry detergent including the fragrance carrier particles formed by example 2.
Figure 5:
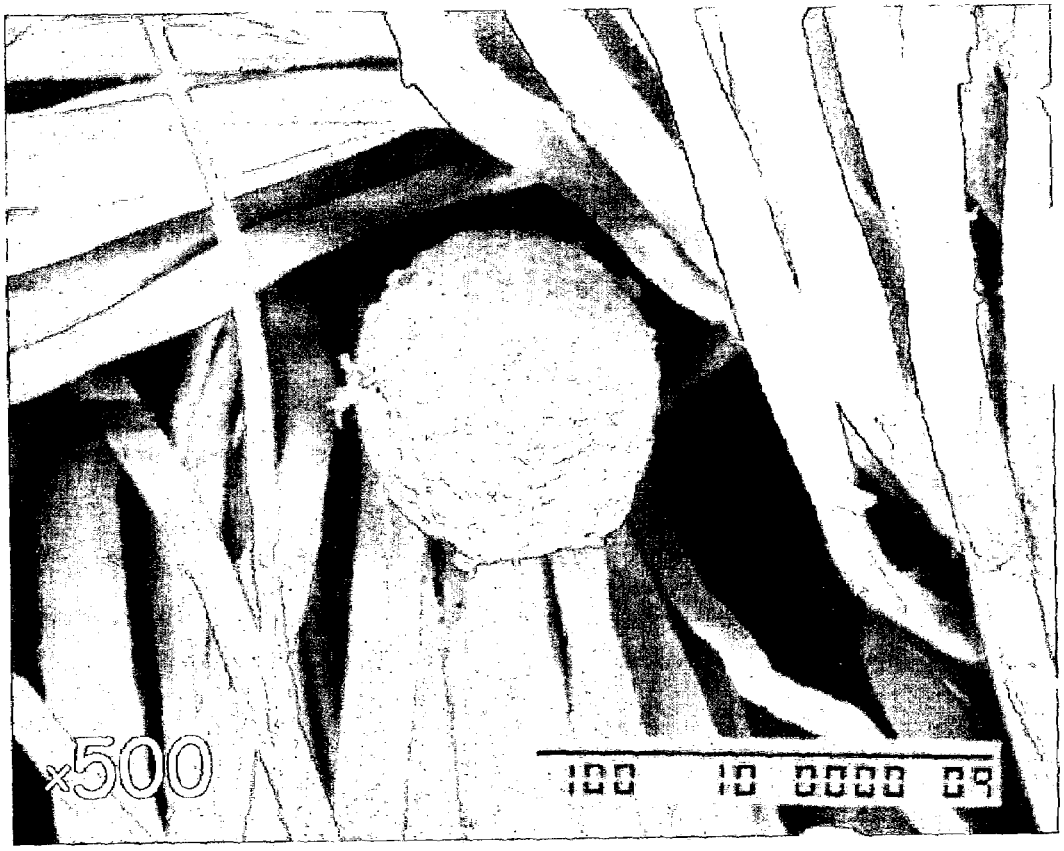
FIG. 5 is a Sem magnified 500 times of a fabric washed with a powder laundry detergent including the fragrance carrier particles formed by example 2.
Figure 6:
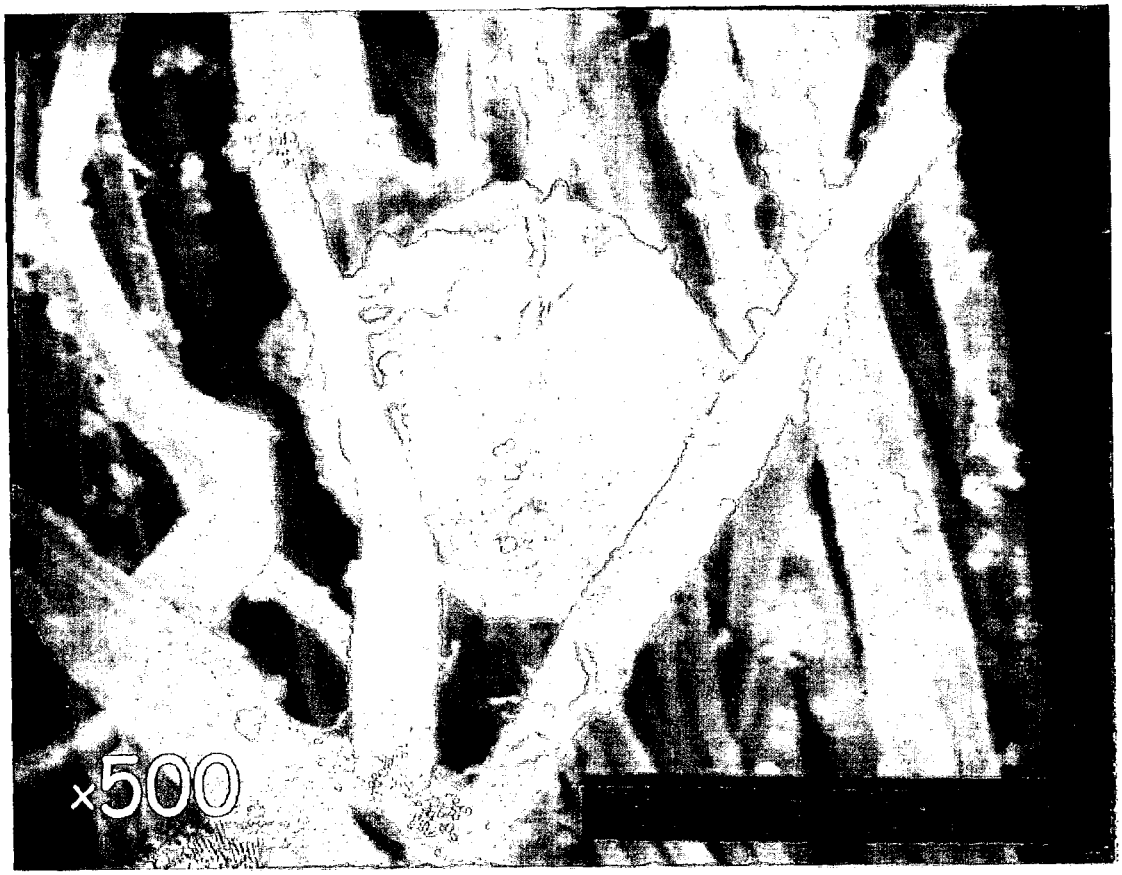
FIG. 6 is a SEM magnified 500 times of a fabric washed with a liquid laundry detergent including the fragrance carrier particles formed by example 2.

The shape and size of the fragrance-carrier particles of the present invention was verified by examining the samples under a scanning electron microscope (SEM). FIG. 1 shows a SEM image magnified at 500 times indicating the particles are spherical and smooth in nature with an average particle size ranging between about 50 microns to about 100 microns. The substantivity of the fragrance-carrier particles of example 2 onto fabric, from a fabric conditioner application is shown in FIG. 2 and in FIG. 3. FIG. 2 shows a SEM magnified 100 times of fabric (towels) washed with a fabric softener comprising the fabric carrier particles formed in example 2. FIG. 3 shows a SEM magnified 350 times of fabric (towels) washed with a fabric softener comprising the fabric carrier particles formed in example 2. The substantivity of the fragrance-carrier particles of example 2 onto fabric, from a powder laundry detergent application is shown in FIG. 4 and FIG. 5. 4 shows a SEM magnified 200 times of a fabric (towels) washed with a powder laundry detergent comprising the fabric carrier particles formed in example 2. FIG. 5 shows a SEM magnified 500 times of a fabric (towels) washed with a powder laundry detergent comprising the fabric carrier particles formed in example 2. The substantivity of the fragrance-carrier particles of example 2 onto fabric, from a liquid laundry detergent application is shown in FIG. 6. FIG. 6 is a SEM magnified 500 times of a fabric (towels) washed with a liquid detergent comprising the fabric carrier particles of example 2.

The invention can be further illustrated by the following examples thereof, although it will be understood that these examples are included merely for purposes of illustration and are not intended to limit the scope of the invention unless otherwise specifically indicated. All percentages, ratios, and parts herein, in the Specification, Examples, and Claims, are by weight and are approximations unless otherwise stated.

Sample Preparation

EXAMPLE 1

The fragrance used in the following examples is a fragrance composition that is not substantive on fabric when used as neat oil. The fragrance composition used is as follows:

| Perfume Composition | Component (% Wt.) |
|---|---|
| Geraniol | 30.0 |
| Dihydro Myrcenol | 20.0 |
| Phenyl Ethyl Alcohol | 5.0 |
| Linalool | 25.0 |
| Tetrahydro Linalyl Acetate | 20.0 |

Fragrance carrier particles were formed having the following compostion;

40% Hydrophobic polymer of polyethylene homopolymer, commercially available from AlliedSignal Inc. as PERFORMALENE™ PL 29% Cationic fabric conditioning agent of methyl bis(hydrogenated ditallowamidoethyl)2hydroxyethyl ammonium chloride, commercially available from Croda Inc. as INCROSOFT 100

1% Cationic charge booster of polyethyleneimine having an average molecular weight of 1800, commercially available from BASF Corporation as LUPASOL™ PR815

30% Fragrance.

The hydrophobic polymer, cationic fabric conditioning agent, and cationic charge booster were melted together to form a clear solution at 90° C. The fragrance was added to the molten mixture while mixing it with a propeller mixer. This molten solution is atomized into a chamber with ambient temperature air passing through the chamber. The atomized droplets freeze into solid particles in the size range of about 20 microns to about 150 microns.

EXAMPLE 2

Fragrance carrier particles were formed having the following compostion;

40% Hydrophobic copolymer of a silicon copolymer modified candelilla wax commercially available from Strahl & Pitsch Inc.

29% Cationic fabric conditioning agent of methyl bis(hydrogenated ditallowamidoethyl)2hydroxyethyl ammonium chloride, commercially available from Croda Inc. as INCROSOFT 100

1% Cationic charge booster of polyethyleneimine having an average molecular weight of 1800, commercially available from BASF Corporation as LUPASOL™ PR815

30% Fragrance

The hydrophobic polymer, cationic fabric conditioning agent, and cationic charge booster were melted together to form a clear solution at 90 degrees C. The fragrance was added to the molten mixture while mixing it with a propeller mixer. This molten solution is atomized into a chamber with ambient temperature air passing through the chamber. The atomized droplets freeze into solid particles in the size range of about 20 microns to about 150 microns.

EXAMPLE 3

Fragrance carrier particles were formed having the following compostion;

40% Hydrophobic polymer of ethylene acrylic acid copolymer, commercially available from AlliedSignal Inc. as ETHYLENE-ACRILIC ACID COPOLYMERS A-C® 540, 29% Cationic fabric conditioning agent of methyl bis(hydrogenated tallow amidoethyl)-2-hydroxyethyl ammonium methyl sulfate, commercially available from the Stepan Company as ACCOSOFT™ 440-75 DEG 1% Cationic charge booster of polyethyleneimine having an average molecular weight of 1800, commercially available from BASF Corporation as LUPASOL™ PR815

30% Geraniol

The hydrophobic polymer, cationic fabric conditioning agent, and cationic charge booster were melted together to form a clear solution at 90 degrees C. The fragrance was added to the molten mixture while mixing it with a propeller mixer. This molten solution is atomized into a chamber with ambient temperature air passing through the chamber. The atomized droplets freeze into solid particles in the size range of about 20 microns to about 150 microns.

Test Methods

Twenty cotton towels having the following dimensions 14"×17" were used for evaluating the performance of the fragrance carrier particles of the present invention. Ten of the towels were 100% cotton and ten were composed of a mixture of 65% polyester and 35% cotton. The fabric was laundered in an American washing machine Kenmore™ 90 series.

Wash Conditions:

| | |
|---|---|
| Fabric Load: | 20 towels |
| Laundry detergent sample size: | 100 grams |
| Fabric softener sample size: | 30 grams |
| Dosing into the machine: | Laundry detergent was dosed directly into the machine<br>Fabric softener was placed in the dispenser |
| Water level: | Small Load |
| Water temperature: | Cold/Cold |
| Cycle: | Short cycle |
| Water temperature: | Cold/Cold |
| Rinse options: | One rinse cycle |
| Speeds: | Heavy duty |

The laundered fabric was line dried overnight in a fragrance free room. The dry fabric was folded into two and placed into an aluminum tray, approximately 5 cm deep, covered with a perforated aluminum sheet, in order to keep it out of view, up to the moment of the sniff-test. The sniff-test was performed on the dry laundered fabric in a "pre-ventilated" room by ten graders, 24 hours following wash. The laundered fabric was then covered with a perforated aluminum sheet, and was evaluated again after one week and two weeks by a sniff-test method.

Odor perception is, by its nature, a very subjective determination. According to the procedure, the samples to be tested are provided to a panel of ten odor specialists who independently rank odor intensity of the dry laundered fabric using a scale of 1 (no perceived odor) to 10 (high odor intensity). Samples yielding an odor ranking below about 2 possess an odor which would hardly be noticed by the general public.

EXAMPLE 4

The performance of a fabric softener product comprising the fragrance carrier particles of Example 2 (i.e., the ability to increase fragrance deposition onto fabric, as well as the ability to prolong fragrance release from the dry laundered fabric over an extended period of time, or yield a high impact fragrance "burst" upon ironing the fabric) was evaluated and compared to the performance of the same fabric softener product comprising the neat fragrance, at the same fragrance level. The unfragranced fabric softener base was a commercial DOWNY™ FREE fabric softener product available from Procter & Gamble Company of Cincinnati, Ohio that is fragrance free.

The laundry samples were prepared at a 1% effective fragrance concentration using the fragrance described in Example 1. The control sample was prepared by weighting into a jar 1 gram of the neat fragrance and 99 grams of the DOWNY™ FREE unfragranced base and the resulting mixture was mixed for one hour using a magnetic stirrer. The fabric softener comprising the fragrance particles of the present invention was prepared by weighting into a jar 3.3 grams of the fragrance particles of example 2 and 96.7 grams of the DOWNY™ FREE unfragranced base and the resulting mixture was mixed for one hour using a magnetic stirrer.

Twenty towels were placed in the washing machine (10 of the towels used were 100% cotton and the other 10 towels were 65% polyester and 35% cotton) with 100 grams of TIDE™ FREE powder detergent dosed directly into the washing machine and 30 grams of fabric softener sample was placed in the fabric softener dispenser.

The following washing machine cycle was used:

| | |
|---|---|
| Fabric Load: | 20 towels |
| Laundry detergent sample size: | 100 grams |
| Fabric softener sample size: | 30 grams |
| Dosing into the machine: | Laundry detergent was dosed directly into the machine<br>Fabric softener was placed in the dispenser |
| Water level: | Small Load |
| Water temperature: | Cold/Cold |
| Cycle: | Short cycle |
| Water temperature: | Cold/Cold |
| Rinse options: | One rinse cycle |
| Speeds: | Heavy duty |

Cloth samples were line-dried for 24 hours and then evaluated at four stages: immediately after drying (24 hours following wash); upon ironing 24 hours following wash; at one week after drying; and at two weeks after drying. The dry fabric was folded into two and placed into an aluminum tray, approximately 5 cm deep, covered with a perforated aluminum sheet, between the evaluation stages, up to the moment of the sniff-test. The sniff-test was performed on the dry laundered fabric in a "pre-ventilated" room by ten graders, and test results are presented below:

| | 24 Hours Following Wash | |
|---|---|---|
| Sample | Dry Fabric | Upon Ironing |
| Neat Fragrance (Control) | 4 | 5 |
| Fragrance Particle (Example 2) | 7 | 9 |

Test results indicate that the cloth samples washed with the fragrance particles of Example 2 are significantly more intense than the control samples washed with the neat fragrance immediately after drying (24 hours following wash).

A significant increase in fragrance intensity was observed upon ironing the fabric laundered with the fragrance particles of Example 2. Although odor intensity of the fabric laundered with the neat fragrance (control) was observed to be directly more intense, upon ironing, no significant increase in odor intensity was observed. Only a slight increase in odor intensity was observed when ironing the fabric laundered with the neat fragrance (control).

| Sample | One Week | Two Weeks |
|---|---|---|
| Neat Fragrance (Control) | 3 | 2 |
| Fragrance Particle (Example 2) | 6 | 5 |

At week one and week two the test results indicate that the cloth samples washed with the fragrance particles of Example 2 are significantly more intense than the control samples washed with the neat fragrance (control). No significant difference in odor intensity was observed between the 100% cotton towels and the towels composed of 65% polyester and 35% cotton. The products comprising the fragrance particles show significant improvement over the performance of the neat fragrance in sustaining the volatile constituents of the fragrance and providing a prolong fragrance release from the dry laundered fabric over an extended period of time.

It is understood that the above-described embodiments are illustrative of only a few of the many possible specific embodiments which can represent applications of the principles of the invention. Numerous and varied other arrangements can be readily derived in accordance with these principles by those skilled in the art without departing from the spirit and scope of the invention.

EXAMPLE 5

The performance of a powder laundry detergent product comprising the fragrance carrier particles of Example 2 (i.e., the ability to increase fragrance deposition onto fabric, as well as the ability to prolong fragrance release from the dry laundered fabric over an extended period of time, or yield a high impact fragrance "burst" upon ironing the fabric) was evaluated and compared to the performance of the same fabric softener product comprising the neat fragrance, at the same fragrance level. The unfragranced powder laundry detergent base was a commercial TIDE™ FREE powder laundry detergent available from Procter & Gamble Company of Cincinnati, Ohio that is fragrance free.

The laundry samples were prepared at a 1% effective fragrance concentration using the fragrance described in Example 1. The control sample was prepared by weighting into a jar 1 gram of the neat fragrance and 99 grams of the TIDE™ FREE unfragranced and the resulting mixture was mixed for about one hour. The powder laundry detergent comprising the fragrance particles of the present invention was prepared by weighting into a jar 3.3 grams of the fragrance particles of example 2 and 96.7 grams of the TIDE™ FREE unfragranced powder laundry detergent base and the resulting mixture was mixed for about one hour.

Twenty towels were placed in the washing machine (10 of the towels used were 100% cotton and the other 10 towels were 65% polyester and 35% cotton) with 100 grams of powder laundry detergent dosed directly into the washing machine.

The following washing machine cycle was used:

| | |
|---|---|
| Fabric Load: | 20 towels |
| Laundry detergent sample size: | 100 grams |
| Dosing into the machine: | Laundry detergent was dosed directly into the machine |
| Water level: | Small Load |
| Water temperature: | Cold/Cold |
| Cycle: | Short cycle |
| Water temperature: | Cold/Cold |
| Rinse options: | One rinse cycle |
| Speeds: | Heavy duty |

Cloth samples were line-dried for 24 hours and then evaluated at four stages: immediately after drying (24 hours following wash); upon ironing 24 hours following wash; at one week after drying; and at two weeks after drying. The dry fabric was folded into two and placed into an aluminum tray, approximately 5 cm deep, covered with a perforated aluminum sheet, between the evaluation stages, up to the moment of the sniff-test. The sniff-test was performed on the dry laundered fabric in a "pre-ventilated" room by ten graders, and test results are presented below:

| | 24 Hours Following Wash | |
|---|---|---|
| Sample | Dry Fabric | Upon Ironing |
| Neat Fragrance (Control) | 3 | 5 |
| Fragrance Particle (Example 2) | 6 | 8 |

Test results indicate that the cloth samples washed with the fragrance particles of Example 2 are significantly more intense than the control samples washed with the neat fragrance immediately after drying (24 hours following wash).

A significant increase in fragrance intensity was observed upon ironing the fabric laundered with the fragrance particles of Example 2. Although odor intensity of the fabric laundered with the neat fragrance (control) was observed to be directly more intense, upon ironing, no significant increase in odor intensity was observed. Only a slight increase in odor intensity was observed when ironing the fabric laundered with the neat fragrance (control).

| Sample | One Week | Two Weeks |
|---|---|---|
| Neat Fragrance (Control) | 2 | 1 |
| Fragrance Particle (Example 2) | 5 | 4 |

At week one and week two the test results indicate that the cloth samples washed with the fragrance particles of Example 2 are significantly more intense than the control samples washed with the neat fragrance (control). The products comprising the fragrance particles show significant improvement over the performance of the neat fragrance in sustaining the volatile constituents of the fragrance and providing a prolong fragrance release from the dry laundered fabric over an extended period of time.

What is claimed is:

1. A solid hydrophobic particle for use as a controlled delivery system for fabric comprising:

a solid particle comprising (i) a hydrophobic material selected from a natural wax or synthetic wax, said natural wax is selected from the group consisting of: animal waxes, beeswax; lanolin, shellac wax, vegetable wax, carnauba wax, candelilla wax, cutina wax, bayberry wax, and mixtures thereof, said synthetic wax is selected from a group consisting of: ethylene-acrylic acid copolymer; polyamide polymer having a molecular weight in the range of from about 6,000 up to about 12,000; and polyethylene-vinyl acetate copolymer, (ii) an active agent, (iii) a cationic charge booster of polyalkyleneimine, and a cationic fabric softener agent selected from the group consisting of an alkyl ammonium fabric softening compound and cationic imidazolinium.

2. The system of claim 1 wherein said particle has a melting point between about 60 degrees C. to about 150 degrees C.

3. The system of claim 1 wherein said synthetic wax comprises polyethylene.

4. The controlled release system of claim 1 where said particle has an average particle diameter of about from 1 micron to about 500 microns.

5. The system of claim 1 wherein said average particle diameter is from about 50 microns to about 200 microns.

6. The system of claim 1 wherein said cationic charge booster comprises polyethyleneimine, having an average molecular weight of 1,800.

7. The system of claim 1 wherein said cationic fabric softener is a dialkyl dimethyl ammonium chloride or alkyl trimethyl animonium compound wherein the alkyl has from 12 to 20 atoms.

8. The system of claim 1 wherein said fabric softener agent comprises methyl bis(hydrogenated tallow amidoethyl)-2-hydroxyethyl ammonium methyl sulfate.

9. The system of claim 1 wherein said fabric softener agent comprises behenyltrimethylammonium chloride.

10. The system of claim 1 wherein said active agent comprises a fragrance.

11. The system of claim 1 wherein said active agent is selected from one or more of the agents of the group consisting of a fragrance, ironing aid, silicones, anti-shrinkage agent, anti-wrinkle agent, fabric crisping agent, spotting agent, germicide, fungicide, stabilizer, preservative, bactericide, flow agent, and mixtures thereof.

12. The system of claim 11 further comprising about 1% to about 50% by weight of a fragrance.

13. The system of claim 1 wherein said natural wax or synthetic wax is present in an amount of about 1% to about 95% by weight, said cationic charge booster is present in an amount of about 0.1% to about 10% by weight and said cationic fabric softener is present in an amount of about 0.1% to about 50% by weight.

14. The system of claim 1 wherein said particle releases said cationic charge booster and said cationic fabric softener agent over an extended period of time.

15. The system of claim 14 wherein said extended period of time is up to about 3 weeks.

16. The system of claim 1 wherein said particle releases an effective amount of said active agent, said cationic charge booster and said cationic fabric softener agent to provide a burst upon heat treatment of said particle.

17. A fabric care product comprising said system of claim 1.

18. The fabric care product of claim 17 wherein said fabric care product is selected from the group consisting of a fabric softener; powder laundry detergent; liquid laundry detergent; rinse added product; drier-added fabric softener product; and ironing added product.

19. The system of claim 1 wherein said controlled release system is in a form of a dry, free-flowing powder composition.

20. The system of claim 1 further comprising silicon copolymer.

21. The system of claim 1 further comprising reaction products of siliconyl copolymer with natural wax or synthetic wax.

* * * * *